US006318416B1

(12) United States Patent
Grueninger

(10) Patent No.: US 6,318,416 B1
(45) Date of Patent: Nov. 20, 2001

(54) SPRING INTERIOR AND METHOD OF MAKING SAME

(75) Inventor: Siegfried Grueninger, St. Gallen (CH)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 09/530,619

(22) PCT Filed: Nov. 12, 1999

(86) PCT No.: PCT/US98/24110

§ 371 Date: Jul. 10, 2000

§ 102(e) Date: Jul. 10, 2000

(87) PCT Pub. No.: WO99/25509

PCT Pub. Date: May 27, 1999

(30) Foreign Application Priority Data

Nov. 13, 1997 (CH) ..... 02620
Feb. 27, 1998 (CH) ..... 00470

(51) Int. Cl.[7] ..... B21F 27/16
(52) U.S. Cl. ..... 140/3 CA; 5/716
(58) Field of Search ..... 140/3 CA; 72/132, 72/138, 139; 267/93; 5/716, 727

(56) References Cited

U.S. PATENT DOCUMENTS

| | | | | |
|---|---|---|---|---|
| 3,386,561 | | 6/1968 | Spuhl . | |
| 3,533,114 | * | 10/1970 | Karpen | 267/93 |
| 3,906,766 | | 9/1975 | Sato . | |
| 4,112,721 | * | 9/1978 | Takase et al. | 72/138 |
| 4,444,036 | | 4/1984 | Shibata . | |
| 4,669,289 | | 6/1987 | Itaya . | |
| 4,672,549 | | 6/1987 | Saxton . | |
| 4,679,266 | | 7/1987 | Kraft . | |
| 4,873,854 | | 10/1989 | Russell et al. . | |
| 4,991,277 | | 2/1991 | Itaya . | |
| 5,259,226 | | 11/1993 | Itaya . | |
| 5,579,810 | * | 12/1996 | Ramsey et al. | 140/3 CA |
| 5,875,664 | | 3/1999 | Scott et al. . | |

FOREIGN PATENT DOCUMENTS

| | | |
|---|---|---|
| 595887 | 12/1947 | (GB) . |
| 0937644 | 9/1963 | (GB) . |
| 1095980 | 12/1967 | (GB) . |
| 1104884 | 3/1968 | (GB) . |
| 1181007 | 2/1970 | (GB) . |
| 1182414 | 3/1970 | (GB) . |
| 1183315 | 4/1970 | (GB) . |
| 1207717 | 7/1970 | (GB) . |
| 1235669 | 6/1971 | (GB) . |
| 1245033 | 9/1971 | (GB) . |
| 1327795 | 8/1973 | (GB) . |
| 1399811 | 7/1975 | (GB) . |
| 1522611 | 8/1978 | (GB) . |
| 2104620 | 3/1983 | (GB) . |
| 2143731 | 11/1986 | (GB) . |

* cited by examiner

*Primary Examiner*—Lowell A. Larson
(74) *Attorney, Agent, or Firm*—Wood, Herron & Evans, L.L.P.

(57) ABSTRACT

The spring interior 10 comprises springs 12 with different spring constants (hardness). The variation of the spring constant is effected by changing the average radius of the windings 13 between the central winding 15 and the two end rings 14 of each individual spring. With a spring winding machine 21 whose bending tools can be set and adjusted by software during the production, in this manner spring interiors 10 may be manufactured which comprises any amount of zones of differing hardness. With this, all springs 12 consist of wire with the same diameter, the same end ring 14 diameter and the same height, and the automatic manufacture may be effected without conversion of the spring interior assembly automatic machines.

4 Claims, 5 Drawing Sheets

95

ENTER ADD COIL TYPE TABLE WIRE TYPE

96

| TYPE | HEIGHT | TURNS | CTR R | END R | INTR | PITCH | KNOT |
|---|---|---|---|---|---|---|---|
| 3 | - | - | - | - | - | - | - |
| 4 | - | - | - | - | - | - | - |
| 9 | 27 | 5 | 2.7 | 6.8 | 3.2 | 2.4 | NO |
| 10 | - | - | - | - | - | - | - |
| 15 | - | - | - | - | - | - | - |
| 16 | - | - | - | - | - | - | - |
| 17 | - | - | - | - | - | - | - |
| 20 | - | - | - | - | - | - | - |
| 22 | 27 | 5 | 2.7 | 6.8 | 4.1 | 2.4 | NO |
| 24 | - | - | - | - | - | - | - |

SPRING INTERIOR AND METHOD OF MAKING SAME

The present invention relates to spring interiors and the manufacture of spring interiors and springs therefor that are of differing degrees of firmness.

BACKGROUND OF THE INVENTION

Interior spring mattresses consist of a multitude of steel springs joined together in a regular grid. Typically, the end rings of the neighboring steel springs are directly connected to one another by way of wire spirals. Alternatively, barrel shaped springs are often sewn or welded into pockets in rows and in turn the pockets lying next to one another are connected to one another. With inexpensive mattresses, all the springs used are designed to be identical, i.e. they have the same spring constants and the mattress is uniformly hard or soft over the whole surface. In order to achieve a greater sleeping comfort there is the desire to design the mattress with different hard or soft zones, in particular to reinforce the heavily loaded zones. The differing hardnesses in the individual mattress regions have up to now been produced in different ways. For example, geometrically identical springs with differing wire strengths may be manufactured and used, in which springs with thicker wires are applied in the regions of greater firmness, e.g. in the central region, and springs with thinner wires are applied in regions that are softer, e.g. in the region of the head or feet. The manufacture of springs of different thicknesses does not present a problem in itself, but on later assembly of the mattress, these springs must be arranged at the correct locations in the spring interior. This is not possible with fully automatically operating machines of the present art since typically springs of different types are usually alternately transferred from the winding machine and inserted into the automatic assembly machine. The springs are laid behind one another in rows and the rows one after the another are connected to each other by wire spirals.

Another possibility of producing various hardness regions within a mattress lies in arranging the springs to lie closer to one another in the region of desired reinforcement. Then, the grid in which the springs are then arranged in the spring interior will no longer be uniform. Two springs may also directly inserted one into another.

The manufacture of a mattress with a non-uniform spring grid as well as also the manufacture of a mattress with springs of differing wire strengths is only possible by way of large scale conversions of conventional machines. In one case, the setup of the assembly machine must be changed, which leads to stoppage time and thus to higher manufacturing costs; in another case, two automatic spring winding machines would be necessary, but differing springs could only be arranged in rows.

Accordingly, there remains a need for a better way of providing spring interiors with regions of differing firmness.

SUMMARY OF THE INVENTION

An object of the present invention is to provide a method which permits the fully automatic manufacture of mattresses with freely definable hardness zones in the spring interior on conventional automatic spring interior assembly machines.

According to principles of the present invention, there is provided a method for manufacturing a spring interior for an interior spring mattress or for cushioned furniture, with zones of differing hardness, in which the springs are produced on spring winding means, are joined together in rows, and are subsequently connected to one another. In particular, while on a spring winding means, the mean radius of one or more inner winding lying between the two end rings is changed so that the spring constant of individual springs or several springs produced after one another is changed. The springs are then transferred directly from the spring winding means to an automatic spring interior assembly machine where they are subsequently, in the sequence of their manufacture, joined together to a spring interior.

According to further principles of the present invention, there is provided a spring interior for a mattress or for cushioned furniture, comprising a multitude of rows arranged parallel next to one another, consisting of a multitude of individual springs with end rings of the same diameter and produced from wire of the same diameter and same material, characterized in that springs with differing mean winding radii of the windings lying between the two end rings are arranged next to one another in the rows and form zones of differing hardness within the spring interior.

According to a preferred embodiment of the present invention, the springs which are fully automatically continuously manufactured on a winding machine with the average winding radii of the windings lying between the end rings of a different size without rearranging the stations subsequent to the winding machine such as the handling, the knotting and the heat treating stations, and without rearranging the spring interior assembly machines. Each spring interior is preferably produced with individually formed, customer-specific hardness zones of differing hardness, position and size, without there being required an adjustment or conversion of the further processing stations or of the transport mechanism between the winding machine and the automatic spring interior assembly machine. Differing hardnesses are provided among longitudinal rows as well as transverse rows. All springs so formed may comprise the same end ring diameter and essentially the same height, while the central sections of the springs, i.e. the central winding of the spring, which gripping and handling tools grasp, hold and convey on manufacture and further processing, are always located at the same predetermined location.

In the present invention, springs with different spring constants may be arranged selectively behind one another within each row of springs, and springs of different spring constants may be arranged from spring row to spring row. As a result, not only can the prior assembly machines be employed but also the overall arrangement of the spring interior, i.e. of the grid, remains the same.

Springs in the mattresses with a multitude of different zones, for example, hard edge and shoulder regions, may be manufactured on a winding machine controlled by software. The appropriate springs of differing hardness are produced by changing the winding diameter in the correct sequence, with the sequence of their manufacture determining their predetermined location at the assembly machine. With this, it is not important whether the spring interior is narrow or wide or whether this mattress is long or standard length. The spring interior need not externally differ from a conventional one and as a result may be further processed in subsequent steps without adaptation of those steps, using the known methods and machines for finishing mattresses, e.g. providing with covers and surrounding them with material.

By way of an illustrated embodiment example, the invention is explained in more detail.

DETAILED DESCRIPTION OF THE DRAWINGS

Figure 1:
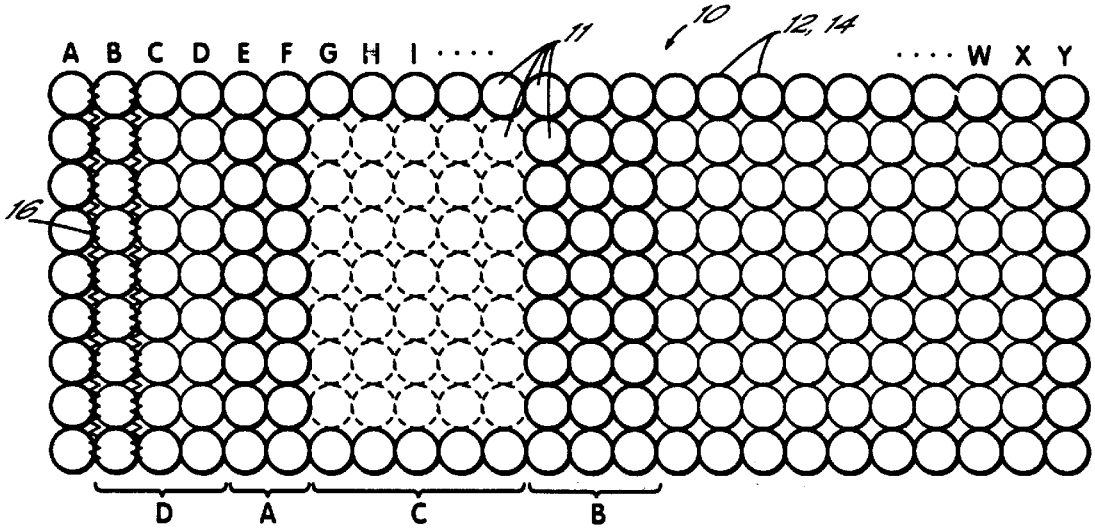
FIG. 1 is a diagrammatic plan view of one preferred embodiment of a spring interior for a mattress according to the present invention.

A spring interior 10, in the schematic representation of FIG. 1, includes, for example, a rectangular array of positions 11, arranged in twenty-four rows a, b, c, . . . x, y of springs 12. Each spring row a, b, c, . . . x, y consists of, for example, nine springs 12 with end rings 14 dimensioned equally, these being connected by wire spirals 16. The manufacture of such a spring interior 10 is effected fully automatically in that upon being coiled on a spring winding machine, springs 13 are sequentially manufactured in rows, for example, of each nine springs 12, and then transferred to a row into an assembly machine where subsequently the rows or groups of rows are successfully joined together with wire spirals 16 to form a spring interior 10. Devices with which springs 12 are manufactured are known from the state of the art. One such device with which the springs 12 may be individually manufactured and joined together to form a spring interior 10, is described in U.S. Pat. No. 4,413,569 and German Patent No. 3020727, expressly incorporated by reference herein.

In the spring interior 10, according to FIG. 1, the springs 12 which lie at the edge of the spring interior 10, and those in a region A on which the shoulder of a person resting on the mattress will come to lie, as well as in a region B on which the hip region of the person will come to lie, are shown in thicker lines. These springs 12 with the thicker liens have a higher spring constant and form regions of the mattress which are harder in order to be able to accommodate and support larger weights in these regions. The springs 12 in regions or zones C, shown in broken lines, represent zones in which the mattress is very soft and thus the springs 12 have a lower spring constant. All remaining springs 12 with lines represented with medium thickness are springs 12 with a spring constant lying between the spring constants of the other springs 12, i.e. they are "normal " springs.

From FIG. 1 it can be seen that in each case whole rows do not necessarily comprise springs 12 of equal hardness, but also within the individual rows, b, c, d, g, h, etc., there are arranged springs 12 with differing spring constants. The end rings 15, however, as already mentioned, are the same for all springs 13 of the spring interior 10. Preferably they have the same diameter and the same geometric shape. Preferably also, all springs 12 consist of the same wire with the same wire strength and wire hardness.

Figure 2:
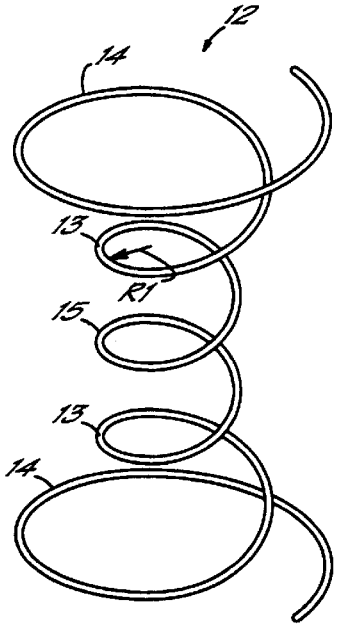
FIG. 2 is a perspective view of a hard spring with windings having a small average diameter.
Figure 3:
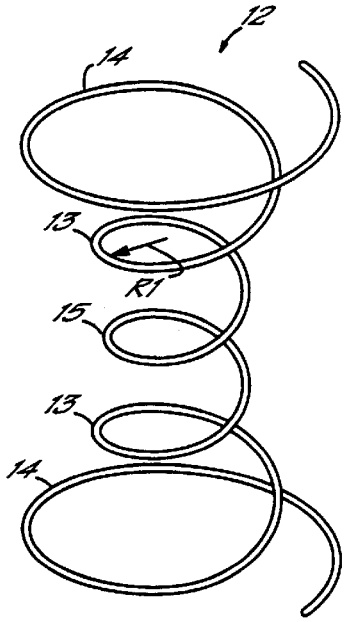
FIG. 3 a view, similar to FIG. 2, of standard spring with a normal hardness.
Figure 4:
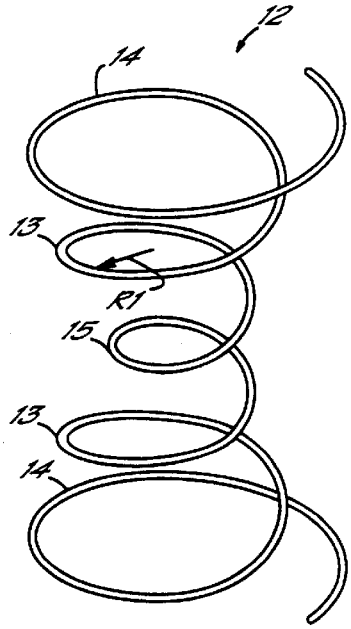
FIG. 4 is a view, similar to FIGS. 2 and 3, of a soft spring with windings having a larger average diameter.

In order for a wire, whose diameter remains constant, to be able to form springs 12 of differing hardness, at least the two spring windings 13 which lie neighboring the end rings 14 are formed with a different mean radius R1 deviating from the "normal" spring according to FIG. 3. The central winding 15 is identical with all three spring types, that is the "normal" n spring according to FIG. 3 and the two spring types with larger spring windings 13 (FIG. 4) or smaller spring windings 13 according to FIG. 2. By way of the enlargement of the average radius R1 of the two windings connected to the end rings 14, the spring constant is reduced and thus the spring 12 becomes softer (FIG. 4). In contrast, by reducing the radius R1 of the winding 13 in the spring 12 according to FIG. 3, the spring constant is increased and thus the spring 12 becomes harder. The enlargement or reduction of the spring constant is always effected with respect to the "normal spring 12 represented in FIG. 3. Nevertheless the size of the central winding is identical with all springs according to the FIGS. 2 to 4. In this context, identical preferably means: when the spring 12 manufactured on the winding machine leaves the machine, the central winding 15 is always located specially at the same location with respect to the end rings and as a result can be grasped by a transport means, e.g. a robot with a pincer or a gripper, at a predetermined location which is the same for all spring designs (cf. FIG. 6). Alternatively all the connecting radii lying between the end rings 14 could also be changed. With this the advantages on handling are partly lost.

Figure 5:
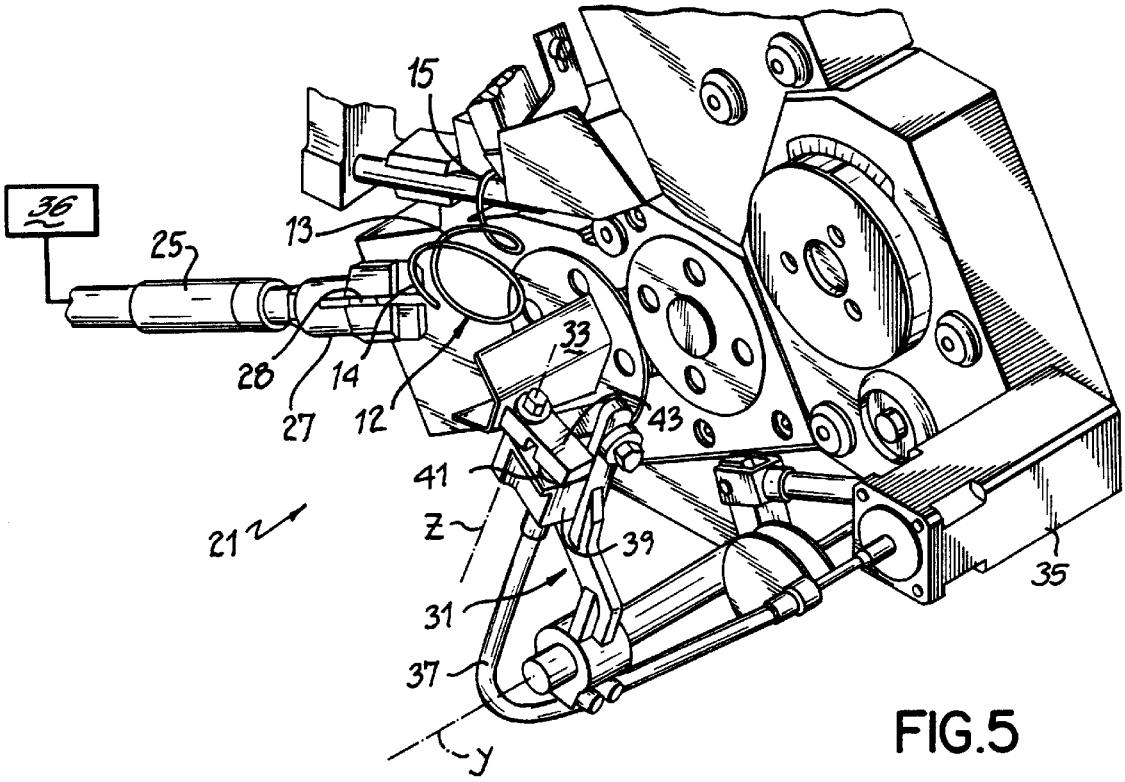
FIG. 5 is a perspective representation of a spring winding machine showing a spring shortly before the completion of its formation by the spring coiling machine.
Figure 6:
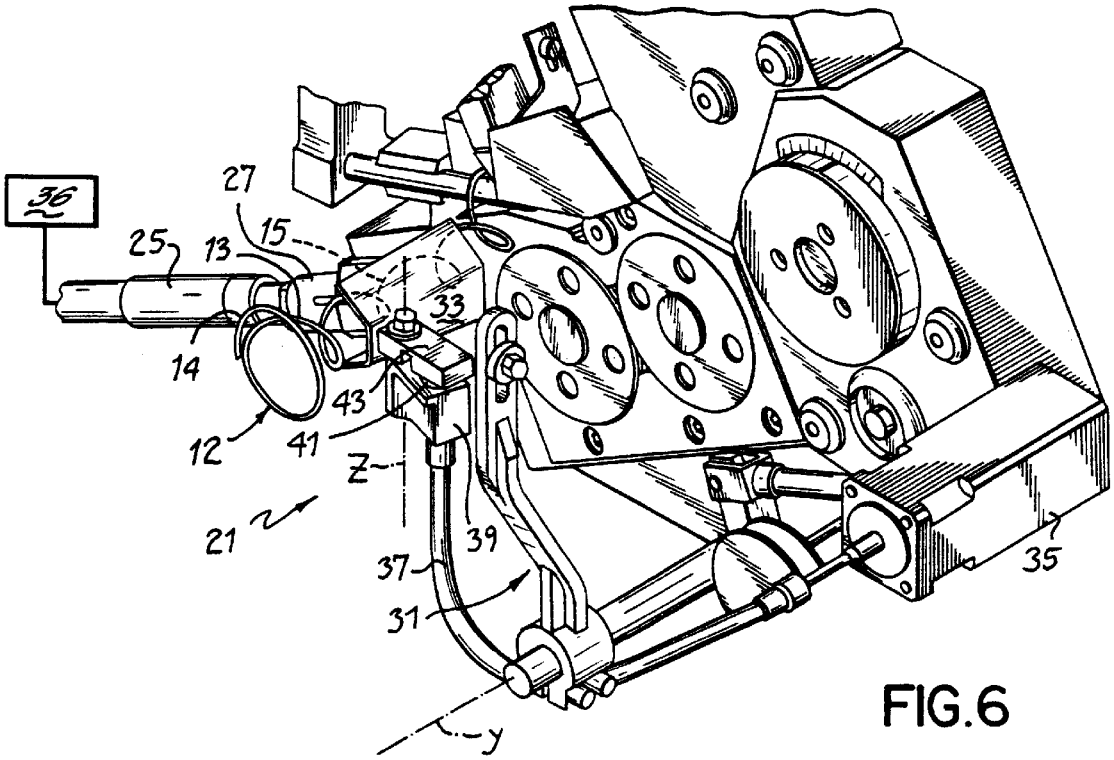
FIG. 6 is a perspective representation of the machine of FIG. 5 showing a completed spring being picked up by the gripping hand.

In the FIGS. 5 and 6 in the perspective representation, mechanical parts of a spring coiling machine 21 are shown. Individually these mechanical parts are not described in detail since they are known to those in the spring making art. Springs 12 as well as the structure for grasping the spring 12 after its completion are shown. In FIG. 5 the spring 12 is shown during the coiling procedure, with two of five windings of the spring 12 completed. A gripping arm 25 consisting of a gripping head 27 and a pneumatically operated gripping hook 28 of a known construction, operated by are actuated by a pneumatic drive 36, lie at a distance to the forming spring 12 so that its forward lying end ring 14 can be guided past on the gripping head 27. A counter holding device 31 which is pivotally mounted about a horizontal axis Y comprises a holding plate 33 which essentially has a U-shaped cross section. The holding plate 33 is likewise pivotally mounted about an axis Z and is infinitely operated by a pivoting drive 35. Between the pivoting drive 35, which is preferably a servodrive, a flexible shaft 37 leads to the pivoting device 39 of the holding plate 33. In the pivoting device 39 there is seated at the end of the flexible shaft 37 an eccentric disk 41 which engages on a pivoting arm 43 which carries the holding plate 33. With the pivoting device 35 thus the position of the holding plate 33 can be changed with respect to the longitudinal axis X of the spring 12 when it is desired that the mean diameter of the second winding 13 undergo a change.

With the continuous manufacture of springs 12 of differing stiffness, at least the two coils neighboring the end rings 14 are varied, synchronously adjusting the wire bending elements of the coil forming machine, i.e. bending rollers, the deflector etc. (all not shown) as well as the geometric position of the holding plate 33. For a spring 12 with a stiffness greater than that of a normal spring with a smaller average diameter of the windings of coiling 12, the holding plate 33 lies at a more acute angle to the axis X of the spring 12 than for a spring which is softer with a the winding 13 of a larger diameter, where the holding plate 33 is set to a larger angle to the axis X.

On removal of the thus completed spring from the spring coiling machine 21, the gripping head 27 moves against the spring 12. In order to be able to securely grasp the spring 12 at its central winding 15, the counter holding device 31 pivots about the axis Y (the pivoting drive is not shown in the FIGS. 5 and 6) until the holding plate 33, in contact with the central winding 15 and the winding 13 which lies neighboring the end winding 14 and the winding 13, presses the spring 12 into the slot of the gripping head 27 where it is rigidly held by a gripping hook 28. As soon as the spring 12 is securely held by the gripping head 27 the end of the spring 12 is separated by a separating device 45 from the end of the wire being supplied, this later forming the front end of the subsequent spring 12.

The counter holding device 31 then pivots back into the original position (FIG. 5) and the gripping hand 25 transports the spring 12 to the next processing station, for example a knotting device with which the spring wire ends at the end winding 14 are knotted.

Control of the spring interior making machine can be accomplished by controlling the coiling machine 21 to produce springs 12 of differing stiffnesses, by controlling the radii of the intermediate coil windings 13 while keeping constant the radii of the center winding 15 and the end windings 14 of each coil 12. The remaining components of the apparatus may be controlled in the same manner as in the manufacture of spring interiors 10 as if the springs 12 were of identical stiffness. This may be provided through the use of a programmed controller that stores spring interior pattern data specifying the stiffnesses of the springs 12 at the different positions 11 of a rectangular array of the springs 12, and also stores spring parameter data of the spring coil radii needed for the intermediate windings 13 that will product springs 12 of the programmed stiffnesses.

Figures 7, 8B:
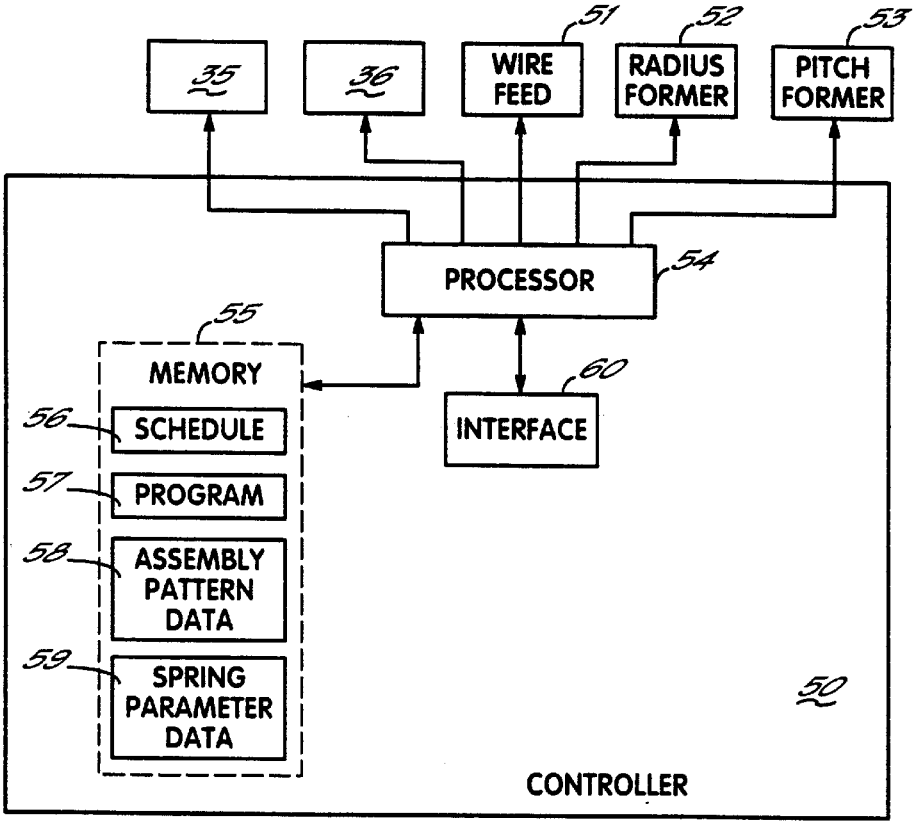
FIG. 7 is a diagram of one example of a control system for operation of the coil forming elements of the spring coiling machine of FIGS. 5 and 6.
FIGS. 8, 8A and 8B are diagrammatic illustrations of a user interface for the control system of FIG. 7.

An example of a control for the coiling machine 21 that will carry out the preferred method is illustrated in FIG. 7, in which a controller 50 is provided having outputs connected to the various operable elements of the machine, including the pivoting drive 35, a drive 36 for the gripper arm 25 and head 27, and spring forming elements. The spring forming controls may include conventional spring forming elements, which are diagrammatically represented as elements for controlling three parameters of a formed spring, namely a wire feeder 51 which controls the length of wire being feed, a coil radius former 52 which controls the curvature of the wire being fed, and a pitch former 53 which controls the pitch or axial displacement of the wire that is being bent into coils of the controlled radius. While the machine is capable of varying the radius and pitch continuously during the formation of any given spring 12, with the preferred embodiment of the present invention, the radius is changed from coil to coil of a given spring, but the pitch is kept constant.

The controller 50 includes a processor 54 which connects through various outputs, which connect through appropriate drivers (not shown), to the controlled elements 35, 36, . . . , 51, 52 and 53. The controller 50 includes non-volatile memory 55 and an operator interface 60. In a portion 56 of the memory 55 job schedule data is stored. In a portion 57 of the memory 55, a program is stored which contains the logic to operate the interface 60, to accept entered data or commands and to display information to the operator, and to automatically operate the elements of the machine 21 in accordance with the operator entered information. The memory 55 also includes a portion 58 in which is stored data of variously defined patterns of spring assemblies 10, including primarily data on the dimensions of the array of individual springs 12 of which the assembly is made, and the types of spring which occupy each of the positions 11 of the array. The memory 55 further includes a portion 59 which includes a table of the various parameters of each of a plurality of spring types that are available to occupy the positions 11 of the spring assembly arrays.

The program in location 55 operates the elements 35, 36, . . . and 51–53 to successively form each of the springs 12 of a selected pattern array defined by information in memory portion 58 in accordance with the spring parameter data stored in memory portion 59.

Figure 8:
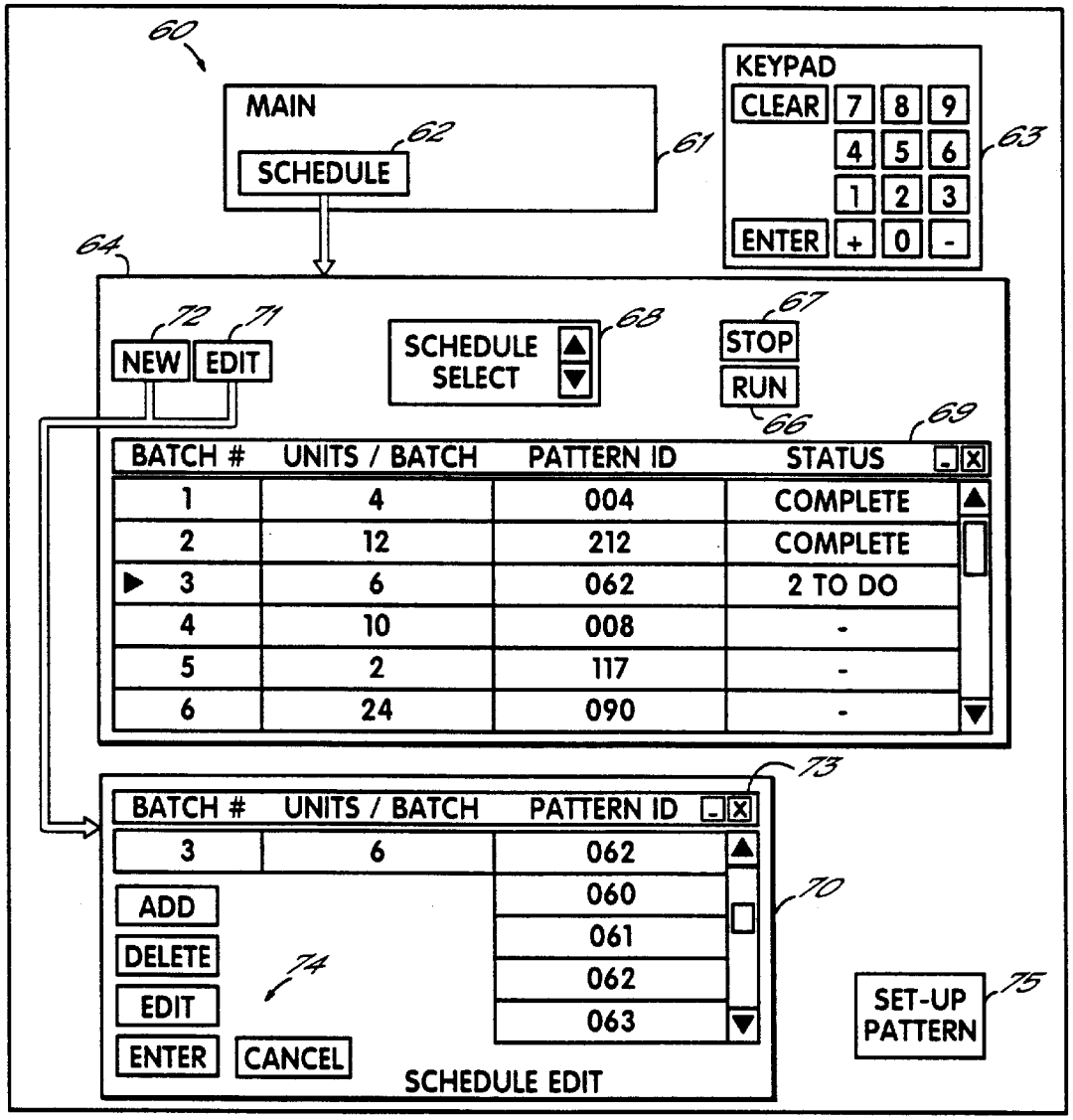

The interface 60 may take any of many forms, one of which is illustrated in FIG. 8 as including a touch screen which may be controlled by software to display various forms, some or all of which may be open at any given time. The forms may, for example, include a MAIN form 61 on which is provided a SCHEDULE command button 62 and a number of other commands and other objects (not shown) that relate to features of the machine 21 and other related equipment that are not important to the description of the present invention. A KEYPAD form 63 is also provided and displayed on the screen of the interface 60 whenever data entry by the operator is an available option.

When the SCHEDULE command button 62 is pushed, a SCHEDULE form 64 is displayed on the screen of the interface 60. This form may be used to monitor the progress of the various jobs being produced on a spring assembly manufacturing apparatus of which the spring coiling machine 21 is a part. The form 64 includes a table 69 of different scheduled batches that are each made up of identical spring assemblies 10. The data record for each batch may include a batch identification number, the number of identical units in the batch, a number or identification code of the pattern which defines the configuration of the spring interior assembly units 10 of the batch and a field containing information on the production status or progress of the batch. An operator may RUN or STOP the running of any batch of spring interiors by selecting the appropriate respective button 66,67, and may move a pointer by selecting up or down arrows 68, or by touching the selected batch on a table, to change select a batch that is the next to be run.

Figure 8A:
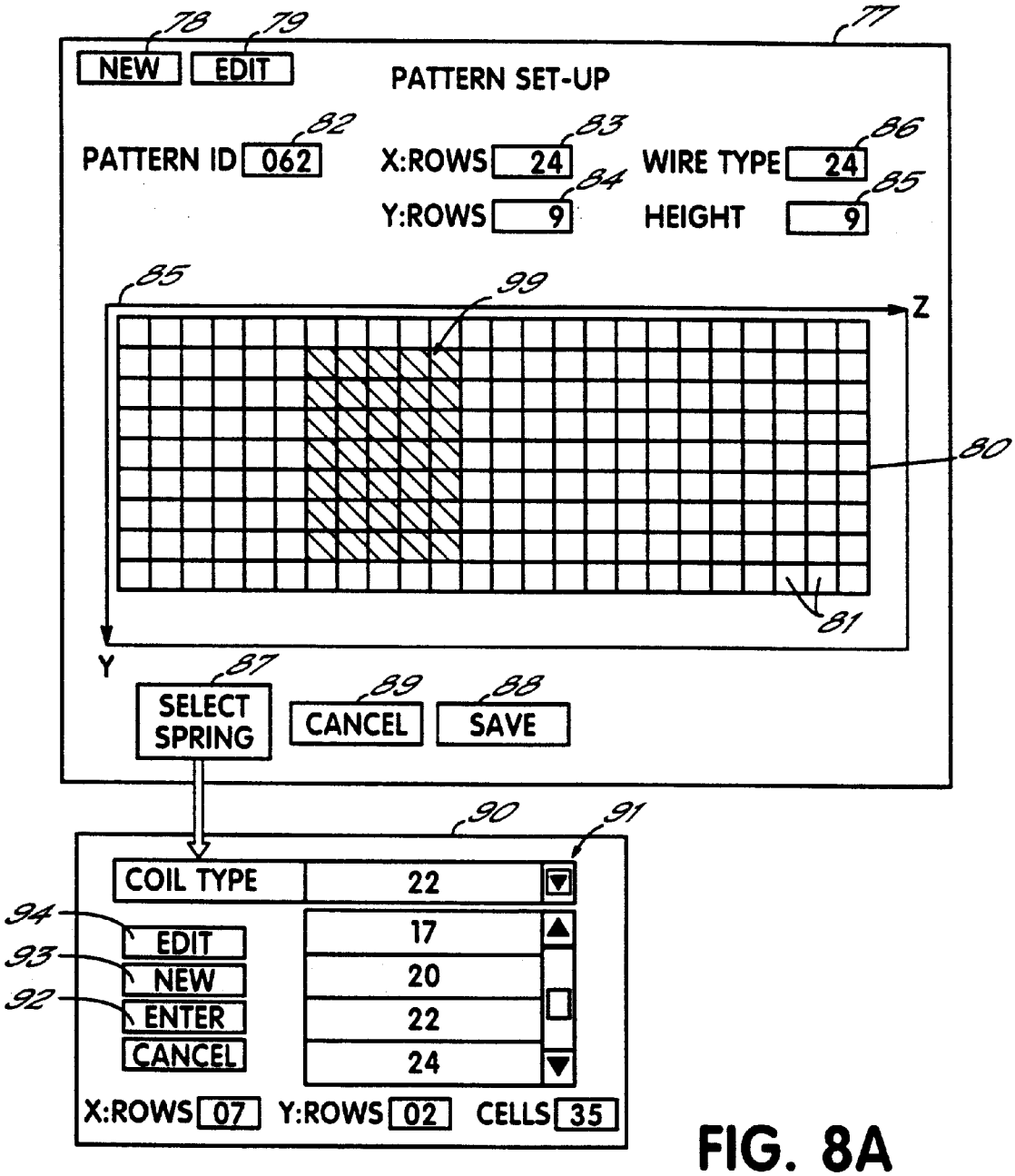

The SCHEDULE form 64 relates to data in the memory portion 56. The form 64 may be provided with command objects that enable an operator to change the data defining the batches that are scheduled to be produced. These command objects may include EDIT and NEW buttons 71, 72 which open a SCHEDULE EDIT form 70, for example, by which the data defining the number of units or the pattern type of the spring interiors 10 of the batch may be defined, or by which a new batch may be identified and its number of units and pattern type may be entered in the schedule. The pattern type may be selected from a list of defined pattern types through a list box 73 on the form 70. Additional buttons 74 may be provided to allow data in the batch records in the schedule to be changed from the form 70. The form 64 is also provided with a SET-UP PATTERN command button 75 which opens a PATTERN SET-UP form 77, which is illustrated in FIG. 8A.

The PATTERN SET-UP form 77 may include a NEW command button 78 and an EDIT command button 79, which, when pushed, present a grid display area 80 that contains an array of cells 81, each corresponding to one of the positions 11 of the springs 12 of a spring interior assembly 10 to be made according to a pattern of a given batch. When the EDIT button 79 is pressed, the grid 80 is filled with data from memory portion 58 for the pattern for the units of the batch that is selected on the SCHEDULE form 64. The number of the pattern applicable to the current batch is displayed in a pattern number box 82 on the form 77. If the operator changes the number in the box 82, by touching the box 82 and then entering another pattern number on the key pad 63, the data for the pattern corresponding to the entered number is displayed. The pattern data will be retrieved from the memory potion 58, and includes fields defining the number of rows in the pattern array and the number of coils per row. These row and coil numbers are displayed in boxes 83,84 respectively provided on the form 77. The dimensions of the displayed array in grid area 80 are automatically resized to conform to the dimensions of the pattern array. In the figure, an array of 24 rows of 9 coils each is illustrated. The form 77 also includes a box 85 that displays coil or spring assembly height and a box 86 that displays wire type of the coils of the spring assembly. The wire type coil height may be indicated as variable, where different coils of the spring assembly are to be made of different wire, but in the preferred embodiment of the invention the wire type and coil height are the same for all springs 12 of the spring assembly 10. When the EDIT button 79 is pushed, the operator may change the data in the boxes 82–86 of the form 77 and in the various cells 81 of the grid 80. The data in the cells 81 of the grid 80 each represents an identification code or number which identifies a record in a table in memory portion 59 that contains parameters data defining a particular configuration of a spring 12. The operator may highlight individual cells 81 or a selected rectangular block 99 of cells 81 and enter a spring type identification code via the keypad 63 or by selecting a number from a list box 91 presented by a SPRING ID form 90 which opens when the operator selects one or more cells of press a SELECT SPRING button 87. When the pattern is defined, the data is saved by pressing the SAVE button 88 or the changes may be canceled by pressing CANCEL button 89 on the form 77.

The SPRING ID form 90 includes objects for selecting a coil type, such as a list box 91 by which a predefined coil type may be selected to be entered into selected cells of the grid 86 of the PATTERN SET-UP window 77 upon the pressing of an ENTER button 92. If a desired coil type is not defined, definition of a new coil type or the editing of the parameters of a previously defined coil type may be carried out by respectively pressing the NEW button 93 or the EDIT button 94, which will open a COIL TABLE form 95.

The COIL TABLE form 95 illustrated in FIG. 8B includes a list 96 of coils of various types, which includes a number of coil records or entries that include a field that contains a coil type identification along with one or more fields that contain data that provides the coil with the desired hardness or stiffness. Preferably, the data defining the parameter that provides the differing stiffnesses of the coils is a single datum of the radius (or the winding diameter in centimeters in the illustrations) of the intermediate coils 13 of the coils of the particular type. Other data can be included such as coil height and wire type which preferably remains the same for all coils of a spring interior assembly or batch of spring interior assemblies. Also, the radii of the center winding 15 and the end windings 14 of a spring 12 are the same for all such springs. The control can be programmed to allow inclusion of springs with a variety of parameters in the table 96, but with the ability of the operator or an engineer to specify the constant parameters that are permitted, with the program disabling selection of springs from the list 96 that do not have the specified wire type or height, for example. Various of the forms 70, 77, 90 or 95, for example, may be password protected and only available to a supervisor or manager.

In operation, for each spring interior 10, the coiling machine 21 produces springs 12 of each row in succession, with each spring possessing the stiffness resulting from the radius of the intermediate windings 13 of each spring 12 of the type programmed for the respective position 11 of the array. Each row of springs is so formed and the rows are transferred into a spring interior assembly apparatus where the coils 12 thereof are laced together and the rows of coils are laced to adjacent rows of coils. As a result, a spring interior 10 such as illustrated in FIG. 1 is produced having the zones A, B, C, D of the various stiffnesses. Such spring interiors 10 are produced with springs formed on conventional hardware, operated controlled in accordance with the present invention, with only the radii of the intermediate windings 13 of the coil springs 12 differing from the springs 12 of one stiffness zone to another. All other parts of the automatic machine may remain as they were before the present invention.

The springs 12 so made have an exactly defined location of the central winding 15 with respect to the gripping hand 25. The constantly equal geometry of the end rings 14 and of the central winding 15 permits a conventional automatic spring interior assembly machine already possessed by a manufacturer of spring interiors to be used to simultaneously and continuously process springs 12 of different hardnesses, without a need for adjusting work in the region of the gripper 25, of other coil handling or transfer mechanisms. In other words: the automatic spring interior assembly machine can process all springs 12 supplied to it independent of their hardness. A suitable software control of the spring winding machine 21 especially of its coil forming elements with which the geometric shape is determined permits springs 12 with differing hardness to be produced in the desired sequence and subsequently in the conventional manner to be further processed in the same manner as exclusively identical springs 12.

Accordingly, a spring interior with predetermined hardness zones A, B, C, D according to FIG. 1 may be manufactured fully automatically in the same manner as a spring interior with equal springs throughout. Such springs 12 may be manufactured one after another on the spring winding machine 21 to whatever hardness is desired. They are then fed to the assembly automatic machines spring by spring in a conventional manner. Since all springs 12 have identical end rings 14, the end rings may be open or knotted. With all springs 12, the central winding 15 is located at the same location, so that the automatic spring interior assembly machines may process the springs 12 as if they were identical. Only the user of the mattress or the one who exactly compares the springs 12 individually coming from the winding machine 21 with one another can determine that the geometric shape is not the same with all springs 12.

With simple means, mattresses and cushioned furniture may be manufactured which are matched to the customer or matched to changing habits and zones of differing hardness may be produced at the desired location.

What is claimed is:

1. A method for manufacturing, for an interior spring mattress or for cushioned furniture, a spring interior having a plurality of rows arranged parallel to one another and each including a plurality of individual springs each having end windings of the same diameter and produced from wire of the same diameter and same material, with different springs of a plurality of said rows having inner windings lying between the two end windings thereof having differing mean winding radii, and with a plurality of said rows having said different springs being arranged next to one another to form zones of differing hardness within the spring interior, the method comprising the steps of:

forming a plurality of rows of springs of a spring interior;

for each of the rows of the spring interior:

automatically controlling a spring forming machine to successively coil individual springs of the row having end windings of the same mean radii, and while changing, from one spring to another spring in the course of coiling the springs of the row, the mean radius of one or more inner windings between two end windings to change the spring constant from one spring to another spring along the row in accordance with a predetermined stiffness pattern to produce a row of springs of differing spring constants arranged in a sequence in which they are coiled on the spring coiling machine, transferring the row of the springs as arranged in the sequence, and then joining the successively coiled arranged sequence of individual springs together in a row;

following the forming for each of the rows of springs of the spring interior, controlling an automatic spring interior assembly machine to connect the plurality of rows of joined springs to one another to form a spring interior that includes the plurality of rows of springs interconnected in a predetermined rectangular array having differing stifness regions, at least a plurality of the rows of which include springs having inner windings of differing radii and therefore of differing hardnesses but having end windings equal radii; and the formed springs having a central winding, and an inner winding between each end winding of the spring and the central winding, and the coiling step includes the step of changing, from one spring to another, the mean radius of an inner winding lying between the central winding and an end winding of the springs.

2. The method of claim 1 wherein, in the coiling step, the geometric shape of the central winding remains geometrically unchanged and independent of the change of mean radius of said inner winding.

3. The method of claim 2 wherein the coiling step includes a coiling windings of the springs in sequences so that the spring interior has at least one zone which includes springs having the mean radius of inner windings lying between the two end windings that is smaller than corresponding inner windings of springs adjacent an edge of the spring interior.

4. A spring interior made according to the method of any of claims 1 through 3.

* * * * *